US006364364B1

(12) United States Patent
Murphy

(10) Patent No.: US 6,364,364 B1
(45) Date of Patent: Apr. 2, 2002

(54) COMBINATION SHIPPING LABEL/ DETACHABLE PACKING SLIP/LABEL

(75) Inventor: Sharon M. Murphy, Wilmette, IL (US)

(73) Assignee: Moore North America, Inc., Grand Island, NY (US)

( * ) Notice: Subject to any disclaimer, the term of this patent is extended or adjusted under 35 U.S.C. 154(b) by 0 days.

(21) Appl. No.: 09/502,830

(22) Filed: Feb. 11, 2000

(51) Int. Cl.[7] ..... B42D 15/00

(52) U.S. Cl. ..... 283/79; 283/71; 283/80; 283/81; 283/101; 283/105; 283/116

(58) Field of Search ..... 283/80, 79, 81, 283/101, 105, 116, 71

(56) References Cited

U.S. PATENT DOCUMENTS 4,955,640 A * 9/1990 Anderson ..... 281/2
5,031,939 A * 7/1991 Webendorfer et al. ..... 283/81
5,203,851 A * 4/1993 Browning et al. ..... 283/81
5,259,906 A 11/1993 Poplawski et al.
5,340,158 A 8/1994 Bartl
5,419,590 A 5/1995 Rothschild
5,484,170 A 1/1996 Hatfield, Jr.
5,547,227 A * 8/1996 Laurash et al. ..... 283/81
5,601,313 A * 2/1997 Konkol et al. ..... 283/81
5,618,064 A 4/1997 Main
5,704,649 A * 1/1998 Small ..... 283/81
5,730,469 A 3/1998 Heimerdinger et al.
5,735,549 A * 4/1998 Konkol et al. ..... 283/81
5,752,722 A 5/1998 Moore et al.
5,776,571 A 7/1998 Michlin et al.
5,833,273 A * 11/1998 Strenk et al. ..... 283/81
5,842,722 A * 12/1998 Carlson ..... 283/81
5,915,730 A * 6/1999 Petkovsek ..... 283/79
6,257,624 B1 * 7/2001 Fabel ..... 283/79

* cited by examiner

*Primary Examiner*—Willmon Fridie, Jr.
*Assistant Examiner*—Mark T. Henderson
(74) *Attorney, Agent, or Firm*—Simpson, Simpson & Snyder, PLLC

(57) ABSTRACT

A combination shipping label and packing slip/label form which comprises a first ply having a top surface and a bottom surface, and a second release liner ply detachably secured to the bottom surface of the first ply. The first ply comprises a detachable shipping label and a corresponding packing slip. The packing slip is detachably secured to the combination shipping label and packing slip form by a substantial die cut through the first ply and the second release liner ply. The packing slip comprises a border section and a bill of materials section separated by a perforation that perforates the first ply and the second release liner ply. The bottom surface of the border section is coated with an adhesive.

8 Claims, 7 Drawing Sheets

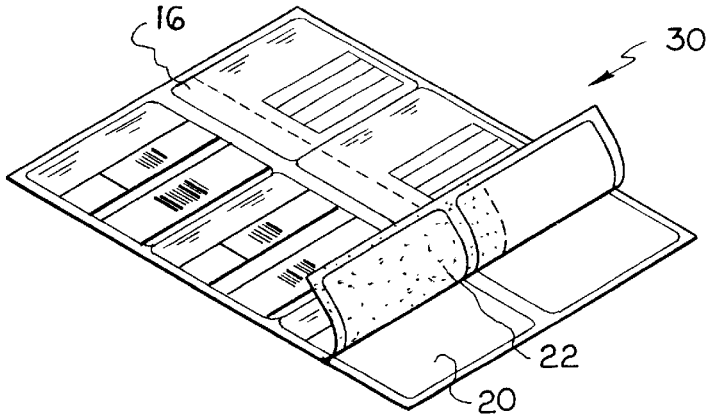
FIG. 5A
FIG. 5B
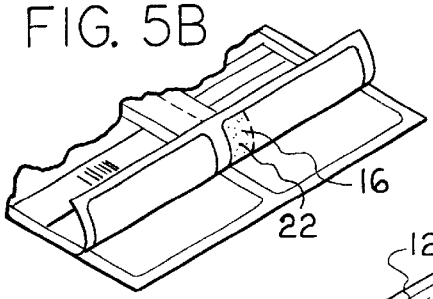
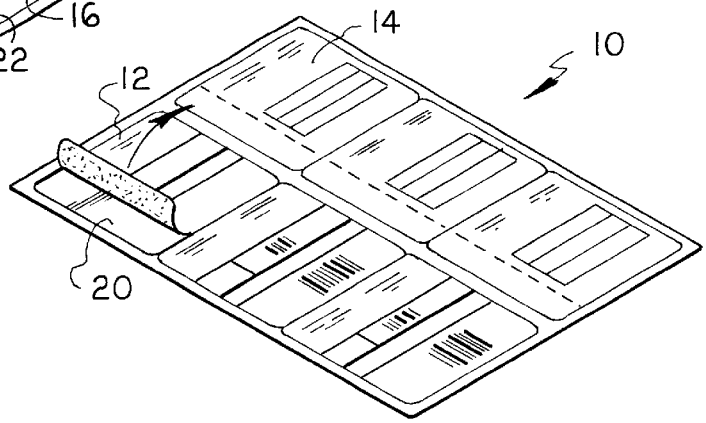
FIG. 6
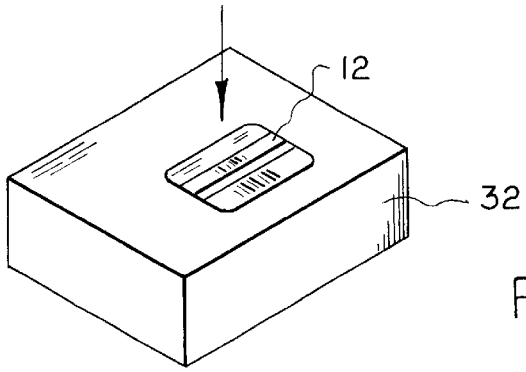
FIG. 7

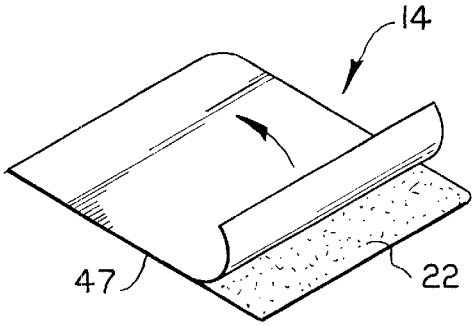
FIG. 12
FIG. 13
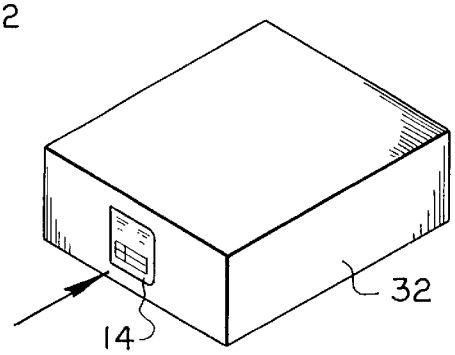
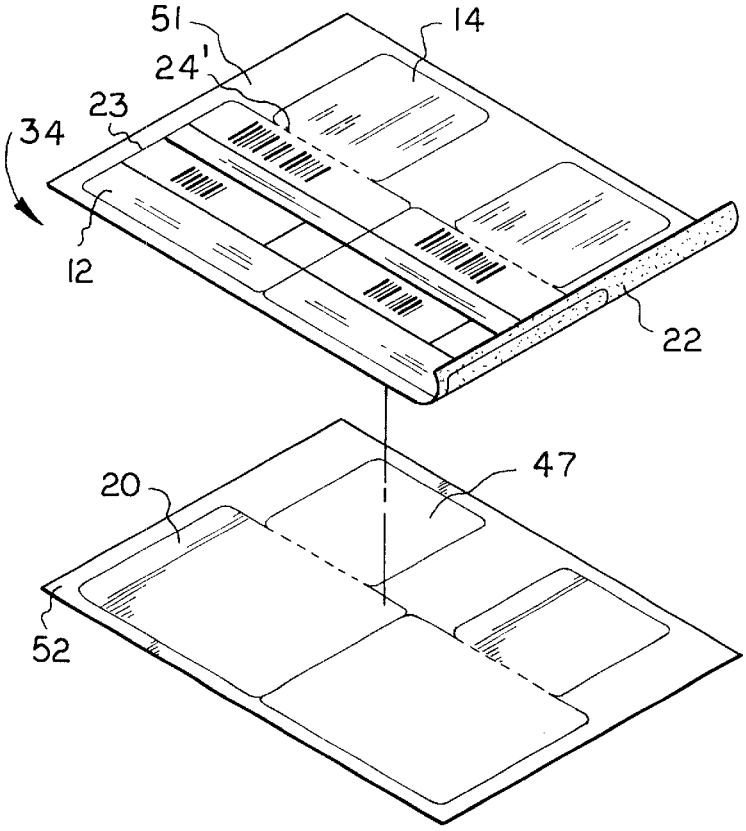
FIG. 15

COMBINATION SHIPPING LABEL/ DETACHABLE PACKING SLIP/LABEL

FIELD OF THE INVENTION

The invention relates generally to business forms and, in particular, to a combination shipping label/detachable packing slip/label.

BACKGROUND OF THE INVENTION

Shipping labels and packing slips are well known in the art. A shipping label is a form affixed to a package for the purpose of indicating the addressee. Shipping labels are quite often adhesive backed, and the addressee's name and address are either pre-printed or custom printed on the label by one of various printing means. When shipping goods, the shipper typically also includes a packing slip, which is a form containing a listing of the contents of the package. Packing slips may be included interior to the package, or may be affixed to the outside of the package. A common packing slip configuration incorporates a paper form stuffed into a transparent pouch or bag secured with adhesive to the package. Thus, the recipient can open the pouch and review the packing slip prior to opening the package.

While the function of a shipping label is easily understood and almost universally applied, people use packing slips in different ways. For example, a shipper can use a packing slip as a guide when packing items in a package, whereas a recipient can use the packing slip to verify the contents of a package before opening. It would be beneficial, then, if the packing slip was designed to accommodate both of these purposes. For example, it would be helpful if the packing slip contained a bordered adhesive strip for temporary affixation to an internal package wall during packing, and yet could be detached from the border either for affixation to an outer package wall, or enclosed in an external pouch. Both shipping labels and packing slips contain common information, such as the recipient's name and address, a tracking number, etc. It is more efficient, then, if both the shipping label and packing slip can be arranged in a single form, and printed at the same time.

Other combination shipping label/packing slip forms are known in the art. U.S. Pat. No. 5,730,469 (Heimerdinger et al.), for example, discloses a combination shipping and packing list label. Unfortunately, this patent does not teach detachability of the packing list label from the corresponding shipping label such that the packing list label can be suspended with a border adhesive from the inside lid of a packing carton (and then later removed for enclosure within the package or within a pouch).

U.S. Pat. No. 5,776,571 (Michlin et al.) discloses a combined form and label construction. Although this patent teaches printing of the combined form and label in a laser printer, the invention contemplates separating the label from the packing slip, affixing the label to the package, and then inserting the packing slip into a pocket defined between the shipping label and the carton. Thus, this patent does not contemplate or solve the problem of using an adhesive-backed packing slip temporarily secured to an inner package wall while packing, and then detaching the slip for enclosure within the package or within a pouch.

U.S. Pat. No. 5,484,170 (Hatfield, Jr.) discloses a unitary shipping label, product information label and packing slip. The patent does not teach the detachability of the packing slip from the corresponding shipping label such that the packing list may be temporarily secured to an inner package wall while packing.

U.S. Pat. No. 5,618,064 (Main) discloses a packing slip and shipping label combination for use on a package. The invention of Main comprises an adhesive shipping label removably attached to the back side of a packing slip. A problem with this design is that, since the packing slip and shipping label are disposed on opposite sides of the form, it is not possible to print both the slip and the label at the same time.

What is needed, then, is a combination packing slip/shipping label on a common ply to facilitate printing of both slip and label at the same time, where the packing slip is operatively arranged to be temporarily affixed to an internal package wall during packing, and yet can be detached for affixation to an outer package wall, or enclosed in an external pouch.

SUMMARY OF THE INVENTION

The invention broadly comprises a combination shipping label and packing slip/label form.

In one embodiment, the combination shipping label and packing slip form comprises a first ply having a top surface and a bottom surface, and a second release liner ply detachably secured to the bottom surface of the first ply. The first ply comprises a detachable shipping label and a corresponding packing slip. The packing slip is detachably secured to the combination shipping label and packing slip form by a substantial die cut through the first ply and the second release liner ply. The packing slip comprises a border section and a bill of materials section separated by a perforation that perforates the first ply and the second release liner ply. The bottom surface of the border section includes an adhesive coating.

A general object of the invention is to provide a form that improves efficiency in packing, shipping, and receiving a package.

These and other objects and advantages of the present invention will be readily appreciable from the following description of preferred embodiments of the invention and from the accompanying drawings and claims.

BRIEF DESCRIPTION OF THE DRAWINGS

FIG. 5A is a perspective view of the combination form of the invention, showing the first ply being peeled away from the release liner ply;

FIG. 5B is a fragmentary perspective view of the combination form shown in FIG. 5A, except showing only the bottom surface of the border section coated with adhesive;

FIG. 6 is a view similar to that shown in FIG. 5 except showing one of the shipping labels being peeled away from the form;

FIG. 7 is a perspective view of the shipping package having one of the shipping labels of the present invention affixed thereto;

FIG. 12 is a perspective view of the bill of materials portion of the packing slip shown in FIG. 11, illustrating how the release liner can be peeled away from the rest of the label;

FIG. 13 is a perspective view of the shipping package illustrating the bill of materials section of the packing slip affixed to the exterior surface of the carton;

FIG. 15 is an exploded view of a second embodiment of the present invention;

DETAILED DESCRIPTION OF THE PREFERRED EMBODIMENT

Figure 1:
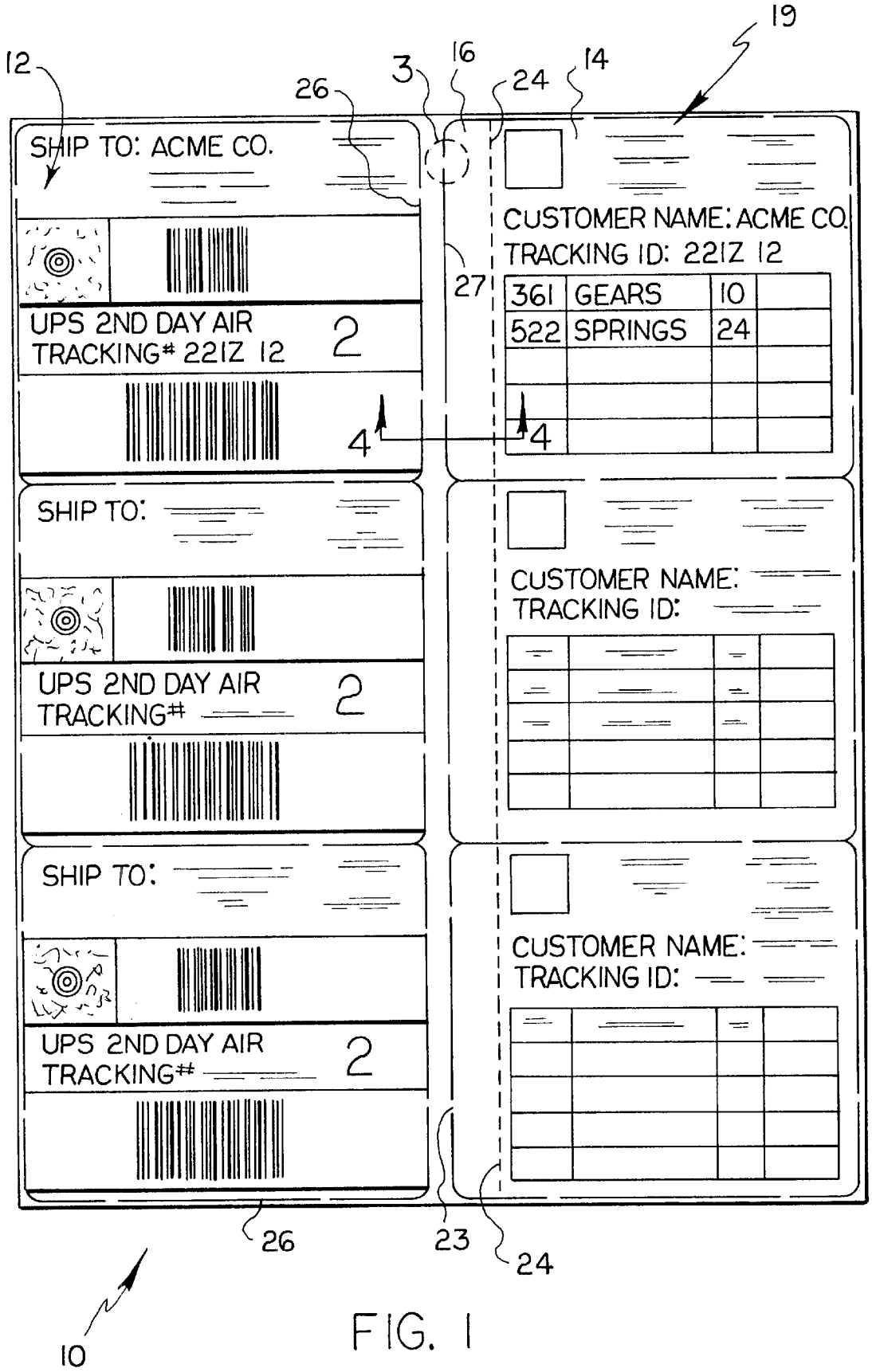
FIG. 1 is a top view of the combination shipping label/detachable packing slip/label form of the invention.

It should be appreciated at the outset that the present invention comprises a combination shipping label/detachable packing slip/label. The business form of the invention can take many forms and be used in various ways. It should be understood that like reference numerals on different drawings represent identical structural elements of the invention. Although the invention is described by reference to two specific preferred embodiments, it is clear that variations can be made without departing from the spirit of the invention as claimed.

The first embodiment of the present invention is illustrated generally in FIG. 1. FIG. 1 is a top view of the combination shipping label/detachable packing slip/label form of the invention. Form 10 is seen generally to include a plurality of shipping labels 12 and corresponding packing slips 19. In the embodiment shown, the form contains three sets of corresponding shipping label/packing slip combinations. By "corresponding", it is meant that the shipping label on the left-hand side of the form corresponds to the packing slip directly adjacent that particular shipping label. For example, the shipping label in the top left-hand corner of the form is for the package addressed to Acme Company. The packing slip located directly to the right of this shipping label corresponds to such shipping label, and therefore also lists Acme Company on the bill of materials section of the form. The tracking number "221Z 12" shown on the shipping label also appears on its corresponding packing slip. Thus, it is seen that there is a one to one correspondence between each shipping label and each packing slip adjacent thereto.

In the form of the invention illustrated in FIG. 1, there are three sets of corresponding shipping label/packing slip sets. However, it should be readily apparent that a form can comprise any number of sets. Also, as shown in the drawing, it is seen that shipping label 12 is bound by a substantial die cut 26. The packing slip is also bounded by a substantial die cut 27. Packing slip 19 is seen to include two portions. Border portion 16 is separated from bill of materials section 14 by perforation 24.

Figure 2:
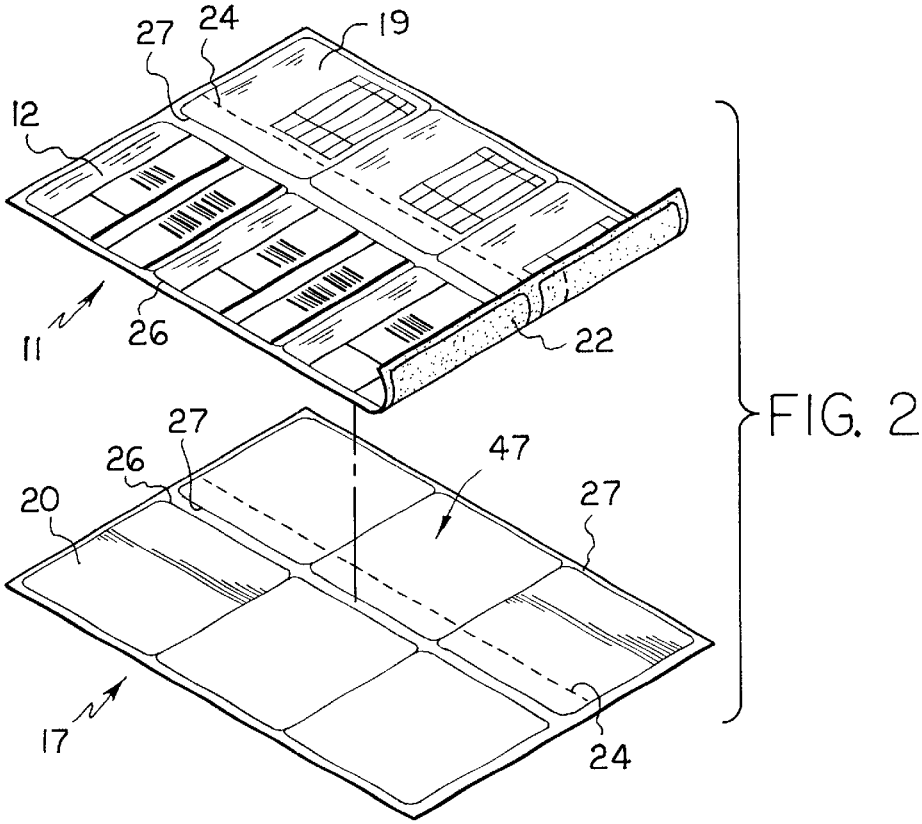
FIG. 2 is an exploded view of the combination shipping label/detachable packing slip/label form of the invention.

FIG. 2 is an exploded view of the combination form shown in FIG. 1. The combination shipping label/packing slip form is seen to include two plies. Top ply 11 comprises a plurality of shipping labels 12 and packing slips 19, whereas bottom ply 17 is a release liner. In the embodiment shown in FIG. 2, the bottom surface of top ply 11 is coated with an adhesive 22. In this embodiment, the adhesive covers substantially the entire bottom surface of the top ply. As shown in the drawing, perforation 24 perforates both top ply 11 and bottom ply 17. Also as shown in the drawing, substantial die cut 23 also perforates both plies.

Figure 3:
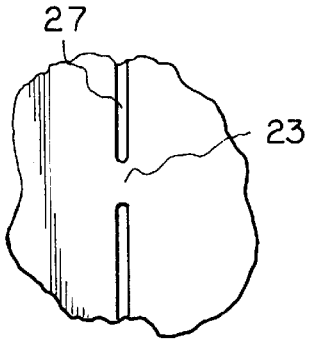
FIG. 3 is a fragmentary enlarged view of one of the die cut bridges of the combination form of the invention.

In the first embodiment of the invention illustrated in FIGS. 1 and 2, substantial die cut 27 perforates both the top ply and the bottom ply, to facilitate removal of the packing slip and its corresponding release liner ply from the form. (As shown in FIG. 2, each packing slip 19 has a corresponding release liner section 47.) As shown in FIG. 3, bridge portion 23 of die cut 27 secures packing slip 19 to the top ply and its corresponding release liner 47 to the bottom ply. Breaking away this bridge portion permits removal of the packing slip and its associated release liner.

Figure 4:
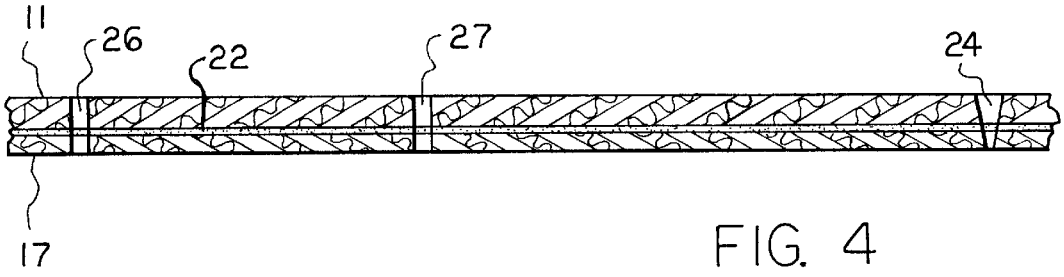
FIG. 4 is a fragmentary cross-sectional view taken generally along line 4—4 in FIG. 1.

FIG. 4 is a fragmentary cross-sectional view taken generally along line 4—4 in FIG. 1. As shown in this view, perforation 24 perforates both the top and bottom plies, as does die cut 26. This view also shows adhesive layer 22 affixed to the bottom surface of top ply 11.

FIG. 5A illustrates an alternative embodiment 30 of the present invention. In this view, the top ply is shown being peeled away from the bottom ply of the form. In this embodiment, adhesive 22 is seen to coat the bottom surface of both the shipping label and the border section of the packing slip. However, no adhesive coats the bill of materials section of the packing slip. In yet another embodiment of the invention, illustrated in FIG. 5B, adhesive 22 is shown to coat only the border section of the bottom surface of the first ply of the packing slip.

FIG. 6 is a perspective view of the first embodiment 10 of the present invention. In this view, shipping label 12 is shown being peeled away from the second ply of the form revealing release liner 20. Once removed, shipping label 12 (which is coated with adhesive) is applied to a package 32 as shown in FIG. 7.

Figure 8:
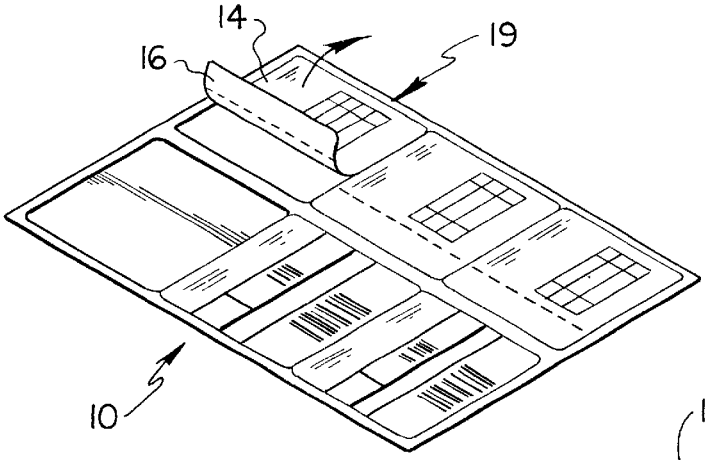
FIG. 8 is a view similar to that a FIG. 6 except showing one of the packing slips being removed from the form.
Figure 9:
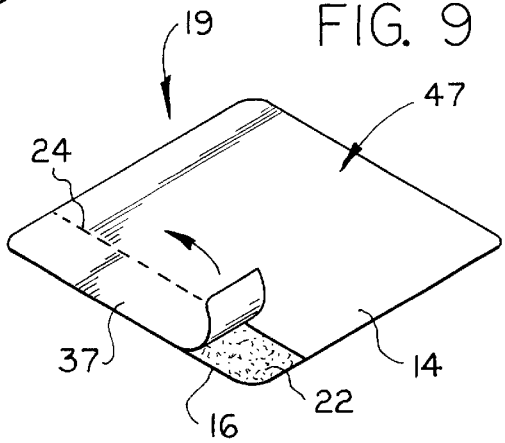
FIG. 9 is a view of the back side of one of the packing slips of the invention, illustrating a border section of the release liner ply being removed from the packing slip.
Figure 10:
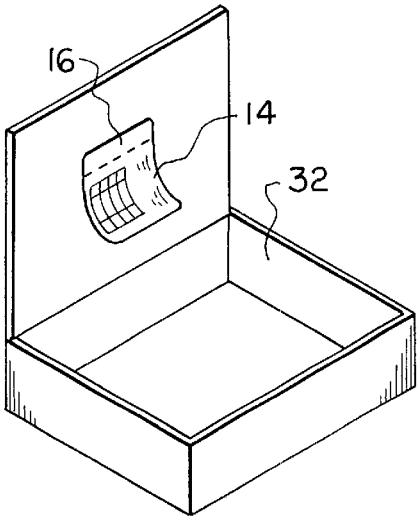
FIG. 10 is a perspective view of an open shipping container, illustrating how the packing slip of the present invention can be temporarily affixed to an inside lid of the shipping carton.
Figure 11:
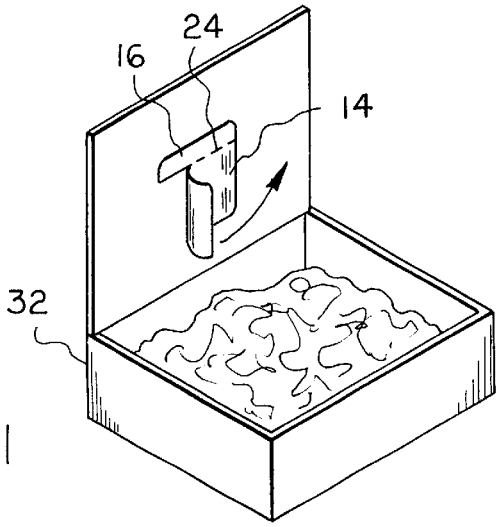
FIG. 11 is a view similar to that a FIG. 10 except showing the bill of materials part of the packing slip being torn away from the border section part of the packing slip affixed to the inside carton lid.

Once a shipping label has been applied to the package, packing slip 19 can be completely removed from the form as shown in FIG. 8. This is done by breaking the die cut bridges 23 along die cut 27 as shown in FIGS. 1–4. Once the packing slip is removed, release liner section 37 may be peeled away from the border section 16 of the packing slip along perforation 24 as shown in FIG. 9. This reveals adhesive 22. With adhesive 22 of border section 16 exposed, the packing slip may be adhere to the inside wall or lid of packing carton 32 as shown in FIG. 10. Affixation of the packing slip to the inside wall of the shipping carton facilitates packing of the carton using the bill of materials as a reference guide. Once the package is filled as shown in FIG. 11, bill of materials section 14 may be detached from border section 16 by tearing the bill of materials section away along perforation 24. This is illustrated in perspective view in FIG. 11.

Once bill of materials section 14 has been detached, release liner 47 can be removed from this section as shown in FIG. 12. The packing slip can then be affixed to an external surface of package 32, as shown in FIG. 13. Alternatively, the packing slip (with the release liner still intact) can be secured within a pouch (not shown) which is then affixed to an external surface of the package.

Figure 14:
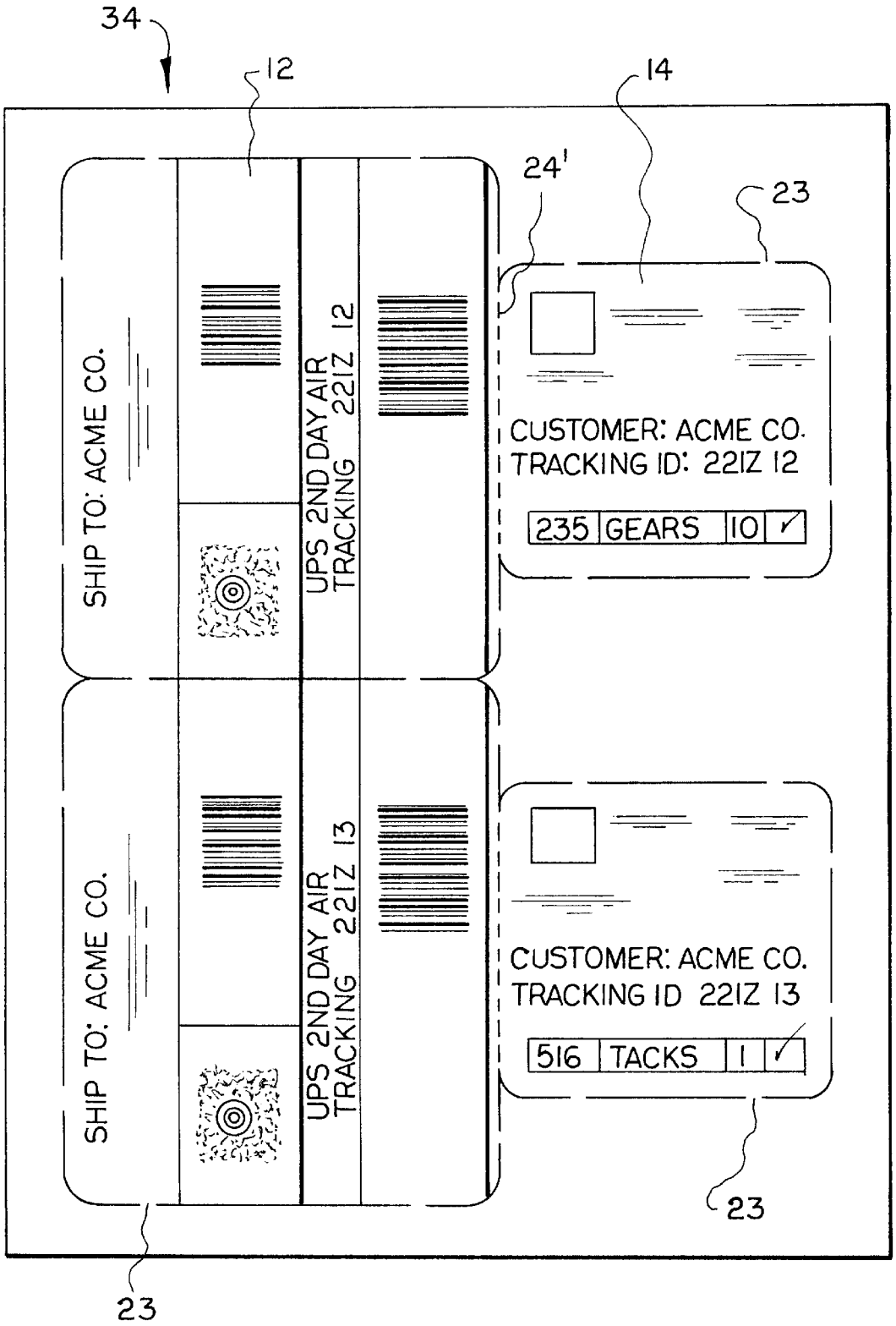
FIG. 14 is a top view of a second embodiment of the present invention.

A second embodiment of the present invention is illustrated generally in FIG. 14. FIG. 14 is a top view of combination shipping label/detachable packing slip/label form 34 of the invention. Form 34 is seen generally to include a plurality of shipping labels 12 and corresponding packing slips 14. In the second embodiment shown, the form contains two sets of corresponding shipping label/packing slip combinations. By "corresponding", it is meant that the shipping label on the left-hand side of the form corresponds to the packing slip directly adjacent that particular shipping label. For example, the shipping label in the top left-hand comer of the form is for the package address to be sent to Acme Co. The packing slip located directly to the right of this shipping label corresponds to that shipping label and the bill of materials therefore also lists Acme Company. The tracking number "221Z 12" shown on the shipping label also appears on its corresponding packing slip. Thus it is seen that there is a one to one correspondence between each shipping label and each packing slip adjacent thereto.

In the form of the invention illustrated in FIG. 14, there are two sets of corresponding shipping label/packing slip sets. However, it should be readily apparent that a form of the invention may comprise any number of shipping label/pack slip combinations. Also, as shown in the drawing, it is seen that shipping label 12 and packing slip 14 are each bound by a substantial die cut 23. Shipping label 12 and packing slip 14 are detachably secured from each other by perforation 24'.

FIG. 15 is an exploded view of the second embodiment of the invention. As shown in this view, combination form 34 comprises top ply 51 and bottom ply 52. Top ply 51 comprises shipping label 12 and corresponding packing slip 14, detachably secured to one another by perforation 24'. In the embodiment shown, the bottom surface of the top ply is completely covered with adhesive 22, although it should be readily apparent that the present invention may also be manufactured with adhesive coating the back of the shipping label only (and not the packing slip), or with adhesive coating the back of the packing slip only (and not the shipping label). In the second embodiment of the invention shown in FIG. 15, die cut 23 perforates both top ply 51 and bottom ply 52. Accordingly, second ply (release liner) shipping label section 20 can be removed from the second ply together with shipping label 12 when removed from the first ply. Similarly, second ply (release liner) packing slip section 47 can be removed from the second ply together with packing slip 14 when removed from the first ply. In other words, the combination shipping label/packing slip, together with release liner, can be completely removed as a whole from the business form.

Figure 16:
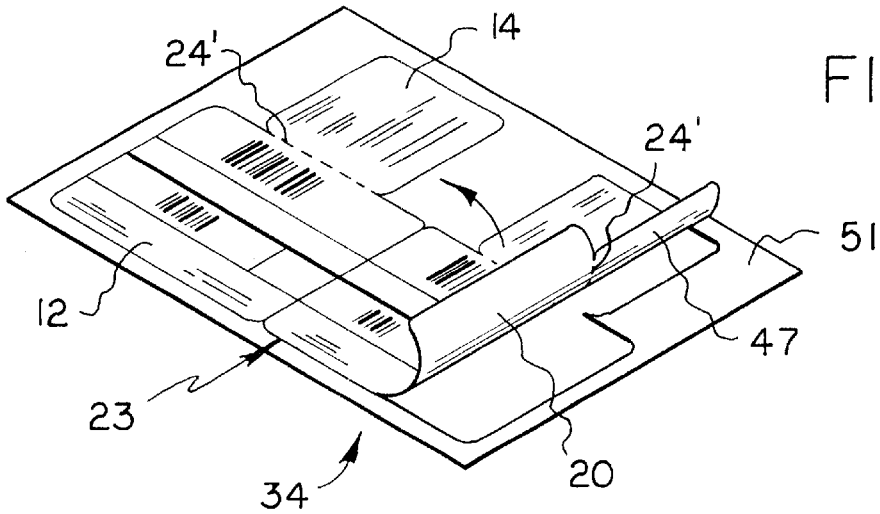
FIG. 16 is a perspective view of the second embodiment of the present invention, illustrating the combination shipping label/packing slip being peeled away from the form.

FIG. 16 is a perspective view of combination form 34. In FIG. 16, shipping label 12 and packing slip 14 can be removed from combination form 34 along substantial die cut 23. Substantial die cut 23 pierces both first ply 51 and second release liner ply 52. Consequently, as shown in FIG. 16, shipping label release liner ply section 20 and packing slip release liner ply section 47 are arranged to be removed from form 34 as an integral piece. Shipping label 12 and packing slip 14 remain detachably secured by perforation 24'.

Figure 17:
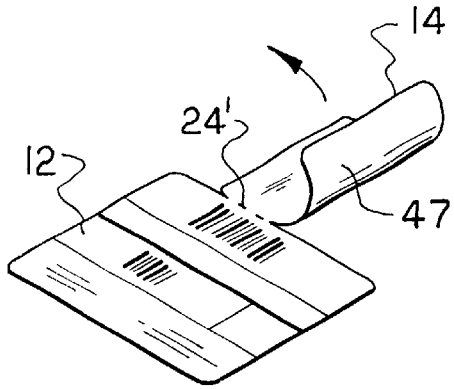
FIG. 17 is a perspective view of the detached shipping label/packing slip of the invention, illustrating the packing slip being detached from the shipping label; and, FIG. 18 is an exploded back view of the shipping label and attached packing slip of the second embodiment of the invention, illustrating the release liners of both being removed.

Once removed from the form, shipping label 12 and packing slip 14 can be separated from each other along perforation 24', as shown in FIG. 17. Upon separation along perforation 24', shipping label release liner ply section 20 and packing slip release liner ply section 47 remain detachably secured to shipping label 12 and shipping label 14, respectively.

Figure 18:
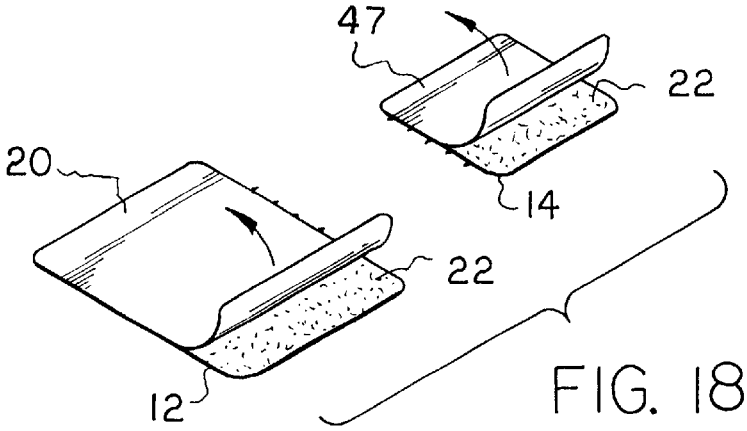

FIG. 18 is a perspective back view of shipping label 12 and packing slip 14 after separation along perforation 24'. Second release liner ply section 20 of the packing slip is shown being peeled away from adhesive coating 22. Similarly, second release liner ply section 47 of the packing slip is shown being peeled away from adhesive coating 22.

Although not shown in the drawings, it should be readily apparent to those having ordinary skill in the art that the packing slip of the second embodiment can comprise a border section and a bill of materials section, as in the first embodiment. The border section and bill of materials section would be detachably secured to one another by a perforation. In this variation of the second embodiment, the border section and the bill of materials section would be separable from one another along the perforation. It is envisioned that the perforation, as in the first embodiment, would perforate both the top ply and the bottom (release liner ply). Thus, upon separation, the release liner sections would remain intact for both the border section and bill of materials sections. The individual release liner sections can then be removed separately if desired. This would accommodate temporary placement of the packing slip on an insider wall or lid of a package during packing. After packing, the bill of materials section of the packing slip can be tom off and applied to an external surface of the package or slipped into an external pouch.

Thus, it is seen that the objects of the invention are efficiently attained, although it should be readily apparent that changes can be made in the structure of the invention without departing from the spirit and scope of the invention as defined by the appended claims.

What I claim is:

1. A form comprising a detachable shipping label and a corresponding packing slip, said form comprising a first ply and a second ply where said second ply is a release liner ply having a bottom surface and an adhesive-free top surface, said first ply having a top surface and a bottom surface, said first ply comprising said detachable shipping label and said corresponding packing slip, said packing slip detachably secured to said form by a substantial die cut through said first ply and said second release liner ply, said adhesive-free top surface of said second release liner ply detachably secured to said bottom surface of said first ply, said packing slip comprising a border section and a bill of materials section separated by a perforation, where said perforation perforates said first ply and said second release liner ply, where said bottom surface of said border section is coated with a repositionable adhesive.

2. A combination shipping label and packing slip form as recited in claim 1 wherein said perforation is a die cut.

3. A combination shipping label and packing slip form as recited in claim 1, wherein said bottom surface of said shipping label is coated with an adhesive.

4. A combination shipping label and packing slip form as recited in claim 1, wherein said bottom surface of said bill of materials section is coated with an adhesive.

5. A combination shipping label and packing slip form as recited in claim 1, wherein said shipping label is detachably secured to said first ply by a substantial die cut.

6. A combination shipping label and packing slip form as recited in claim 1, wherein said top surface of said shipping label and said top surface of said corresponding packing slip each include at least some common printed indicia.

7. A combination shipping label and packing slip form as recited in claim 6, wherein said at least some common printed indicia includes a recipient's name.

8. A combination shipping label and packing slip form as recited in claim 6, wherein said at least some common printed indicia includes a package tracking number.

* * * * *